US010472912B2

(12) United States Patent
Haley et al.

(10) Patent No.: US 10,472,912 B2
(45) Date of Patent: Nov. 12, 2019

(54) SYSTEMS AND METHODS FOR CORE RECOVERY

(71) Applicant: Schlumberger Technology Corporation, Sugar Land, TX (US)

(72) Inventors: Caleb James Haley, Larose, LA (US); Johnathan Adam Wallis, Fort Worth, TX (US); Ali Mamdouh Osman, Houma, LA (US); Robert L. Jeffries, New Orleans, LA (US); Andrea Caines, New Orleans, LA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 112 days.

(21) Appl. No.: 14/830,952

(22) Filed: Aug. 20, 2015

(65) Prior Publication Data

US 2016/0053564 A1 Feb. 25, 2016

Related U.S. Application Data

(60) Provisional application No. 62/041,485, filed on Aug. 25, 2014.

(51) Int. Cl.
*E21B 10/02* (2006.01)
*E21B 25/00* (2006.01)
(Continued)

(52) U.S. Cl.
CPC ..... *E21B 25/00* (2013.01); *E21B 4/006* (2013.01); *E21B 7/068* (2013.01); *E21B 49/06* (2013.01); *E21B 49/10* (2013.01)

(58) Field of Classification Search
CPC ..... E21B 44/00; E21B 47/00; E21B 7/068; E21B 10/02; E21B 25/00; E21B 49/06; E21B 49/10; E21B 4/006
See application file for complete search history.

(56) References Cited

U.S. PATENT DOCUMENTS 4,714,449 A 12/1987 Woerner et al.
4,914,591 A 4/1990 Warren et al.
(Continued)

FOREIGN PATENT DOCUMENTS

MX PA01009429 A 7/2004

OTHER PUBLICATIONS

Abdullah Humaid Al Jarwan, Adnan Mohammed Ahmed Al Menhali, Khalid Abdul Menem Saif Al Kindi, Ergun Kuru, Ferda Akgun, "Optimization of Drilling Operational Parameters and UBD Feasibility Study in a Mature UAE Field Wells", SPE 118082-MS-P, Abu Dhabi International Petroleum Exhibition and Conference, Nov. 3-6, 2008, Abu Dhabi, UAE.

*Primary Examiner* — David J Bagnell
*Assistant Examiner* — Dany E Akakpo
(74) *Attorney, Agent, or Firm* — Trevor G. Grove

(57) ABSTRACT

The present disclosure relates to systems and methods for determining the retraction rate of a coring bit based on sensed environmental factors associated with coring operations. In certain embodiments, a downhole tool is positioned in a wellbore extending into a subterranean formation, coring operations are commenced by rotating a coring bit of the downhole tool and extending the rotating coring bit into a first location along a sidewall of the wellbore, a first environmental factor associated with the coring operations at the first location is sensed, and a rate of retraction of the coring bit at the first location is determined based on the first sensed environmental factor.

6 Claims, 7 Drawing Sheets

(51) Int. Cl.

| | |
|---|---|
| ***E21B 44/00*** | (2006.01) |
| ***E21B 47/00*** | (2012.01) |
| ***E21B 49/06*** | (2006.01) |
| ***E21B 49/10*** | (2006.01) |
| ***E21B 4/00*** | (2006.01) |
| ***E21B 7/06*** | (2006.01) |

(56) References Cited

U.S. PATENT DOCUMENTS

| | | | | |
|---|---|---|---|---|
| 5,667,025 | A | 9/1997 | Haessly et al. | |
| 5,959,547 | A | 9/1999 | Tubel et al. | |
| 6,186,248 | B1 | 2/2001 | Silay et al. | |
| 6,371,221 | B1 * | 4/2002 | Harrigan | E21B 4/04 175/26 |
| 7,191,831 | B2 | 3/2007 | Reid et al. | |
| 7,293,715 | B2 | 11/2007 | Bargach et al. | |
| 7,530,407 | B2 | 5/2009 | Tchakarov et al. | |
| 7,673,704 | B2 | 3/2010 | Phan et al. | |
| 2009/0090555 | A1 | 4/2009 | Boone et al. | |
| 2009/0114447 | A1 | 5/2009 | Reid, Jr. et al. | |
| 2009/0133932 | A1 | 5/2009 | Church | |
| 2009/0173539 | A1 | 7/2009 | Mock et al. | |
| 2012/0012393 | A1 * | 1/2012 | Kumar | E21B 25/00 175/58 |
| 2012/0138362 | A1 * | 6/2012 | Koederitz | E21B 44/00 175/26 |
| 2012/0152011 | A1 | 6/2012 | Zamora et al. | |
| 2012/0318579 | A1 | 12/2012 | Yang et al. | |

* cited by examiner

SYSTEMS AND METHODS FOR CORE RECOVERY

CROSS-REFERENCE TO RELATED APPLICATION

This application claims benefit of U.S. Provisional Patent Application Ser. No. 62/041,485, filed Aug. 25, 2014, which is herein incorporated by reference.

BACKGROUND OF THE DISCLOSURE

Wellbores or boreholes may be drilled to, for example, locate and produce hydrocarbons. During a drilling operation, it may be desirable to evaluate and/or measure properties of encountered formations and formation fluids. In some cases, a drillstring is removed and a wireline tool deployed into the borehole to test, evaluate and/or sample the formations and/or formation fluid(s). In other cases, the drillstring may be provided with devices to test and/or sample the surrounding formations and/or formation fluid(s) without having to remove the drillstring from the borehole.

Some formation evaluation operations may include extracting one or more core samples from a sidewall of the borehole. Such core samples may be extracted using a coring assembly or tool that is part of a downhole tool, which may be conveyed via a wireline, drillstring, or in any other manner. Typically, multiple core samples are extracted from multiple locations along the borehole and stored in the downhole tool. The stored core samples may then be retrieved at the surface when the downhole tool is removed from the borehole and tested or otherwise evaluated to assess the locations corresponding to the core samples.

SUMMARY

The present disclosure relates to a method that includes positioning a downhole tool in a wellbore extending into a subterranean formation, commencing coring operations by rotating a coring bit of the downhole tool and extending the rotating coring bit into a first location along a sidewall of the wellbore, sensing a first environmental factor associated with the coring operations at the first location, and determining a rate of retraction of the coring bit at the first location based on the first sensed environmental factor.

The present disclosure also relates to a system that includes a downhole tool designed for conveyance within a borehole extending into a subterranean formation. The downhole tool includes a hydraulic pump driven by a motor, an actuator linearly driven by hydraulic fluid received from the hydraulic pump and designed to retract a coring bit from the downhole tool, a sensor designed to sense a coring operation environmental factor, and a controller designed to execute instructions stored within the downhole tool to drive the actuator at a rate of retraction based on the sensed coring operation environmental factor.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
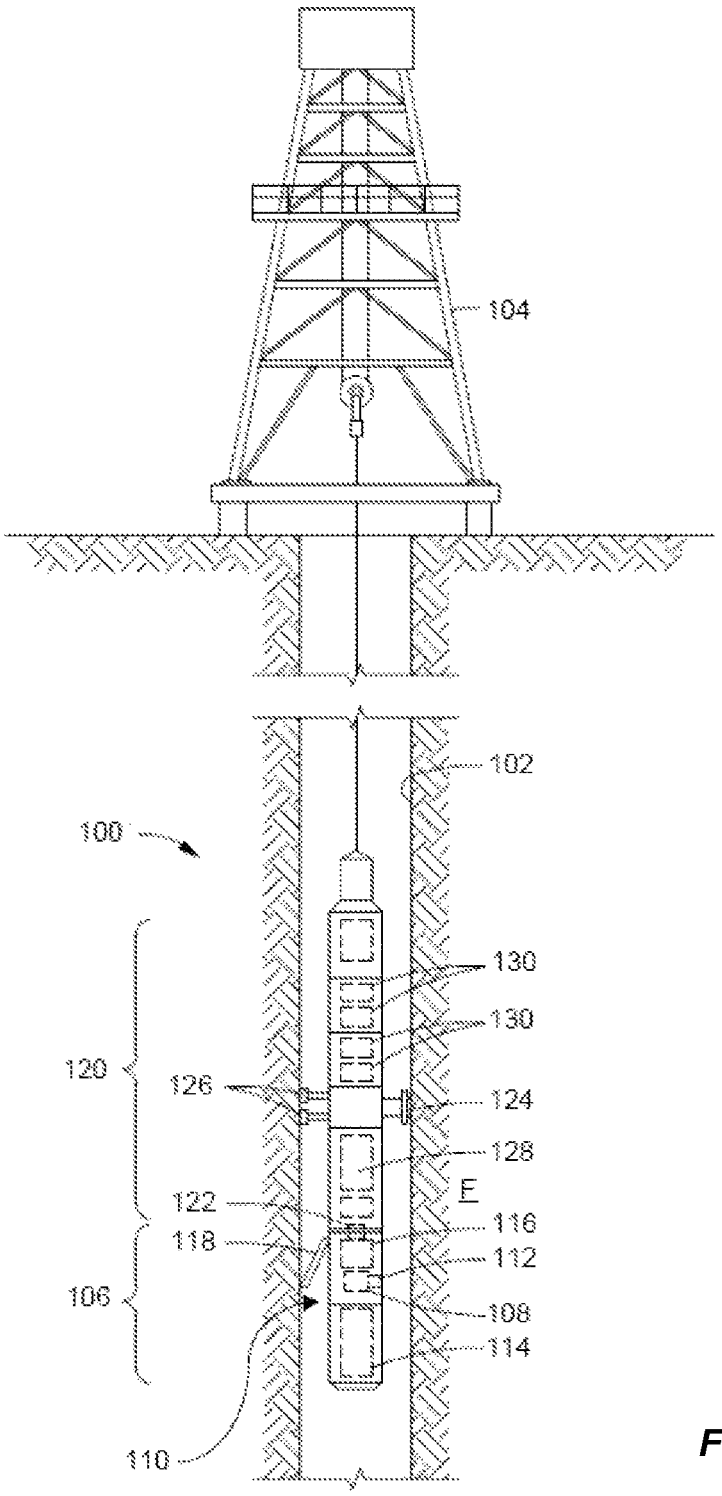
FIG. 1 is a schematic illustration of a wireline downhole tool that may employ methods for determining a rate of retraction of a coring bit, according to aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure relates to systems and methods for determining a rate of retraction of a coring bit. According to certain embodiments, the rate of retraction of the coring bit may be determined based on a sensed environmental factor associated with coring operations. In certain embodiments, a controller may be designed to execute instructions stored within a downhole tool to drive an actuator for retracting the coring bit at a rate of retraction based on the sensed environmental factor. In certain embodiments, a slower rate of retraction may be used when the sensed environmental factor indicates an unconsolidated formation, thereby reducing the possibility of the core being left in the formation, sliding out of the coring bit, or both.

The present disclosure introduces a coring tool having a bit rotating speed ("BRS") sensor, a torque at bit ("TAB") sensor, a weight on bit ("WOB") sensor, and a bit rate of penetration ("ROP") sensor. These measurements may be transmitted to a surface operator while a coring operation is taking place and may be used to monitor the operation. These measurements may further be processed to extract formation properties, such as a compressive strength. Such processing may be performed by a controller downhole, such that the downhole coring tool may automatically adjust to the formation and coring conditions.

The coring tool of the present disclosure may also comprise a bit rotation motor, configured to rotate the coring bit, and a controller (e.g., a downhole controller), configured to control the rotating speed of the bit rotation motor. The controller may be configured to, for example, set a high rotating speed in consolidated formations and a low rotating speed in unconsolidated formations. The detection of the formation characteristics (consolidated versus unconsolidated) may be performed using one or more of a TAB measurement, a ROP measurement, and a WOB measurement. Such detection may also be performed automatically, by the downhole controller or otherwise.

The coring tool of the present disclosure may also comprise a WOB motor, configured to extend the coring bit into the formation, and a controller (e.g., the same downhole controller), configured to control the rotating speed of WOB motor, such as for expediting the coring operation while preventing stalling of the bit rotation motor. The controller may be configured to, for example, set the rotating speed of WOB motor so that the TAB measurement is maintained below a stalling torque value.

While the example apparatus and methods described herein are described in the context of wireline tools, they are also applicable to any number and/or type(s) of additional and/or alternative downhole tools such as drillstring and coiled tubing deployed tools.

FIG. 1 is a schematic illustration of a wireline downhole tool or toolstring 100 deployed in a borehole 102 and suspended from a rig 104 according to one or more aspects of the present disclosure. The toolstring 100 includes a core sampling assembly 106 having a coring tool assembly 108, which includes a coring bit assembly 110 having a coring bit 112. The core sampling assembly 106 further includes a storage location or area 114 for storing core samples, and associated actuation mechanisms 116. The storage location or area 114 is configured to receive sample cores, which may be disposed in a sleeve, canister or, more generally, a sample container or other sample holder. At least one brace arm 118 may be provided to stabilize the toolstring 100 in the borehole 102 while the coring bit 112 is extracting a core sample.

The toolstring 100 may further include additional systems for performing other functions. One such additional system is illustrated in FIG. 1 as a formation testing tool 120 that is operatively coupled to the core sampling assembly 106 via a field joint 122. The formation testing tool 120 may include a probe 124 that is extended from the formation testing tool 120 to be in fluid communication with a formation F. Back up pistons 126 may be included in the toolstring 100 to assist in pushing the probe 124 into contact with the sidewall of the borehole 102 and to stabilize the toolstring 100 in the borehole 102.

The formation testing tool 120 shown in FIG. 1 also includes a pump 128 for pumping sample fluid, as well as sample chambers 130 for storing fluid samples. The locations of these components are only schematically shown in FIG. 1 and, thus, may be provided in locations within the toolstring 100 other than those illustrated. Other components, such as a power module, a hydraulic module, a fluid analyzer module, and other devices, may also be included.

The example apparatus of FIG. 1 is depicted as having multiple modules operatively connected together. However, the example apparatus may also be partially or completely unitary. For example, the formation testing tool 120 may be unitary, with the core sampling assembly 106 housed in a separate module operatively connected by the field joint 122. Alternatively, the core sampling assembly 106 may be unitarily included within the overall housing of the toolstring 100.

Figure 2:
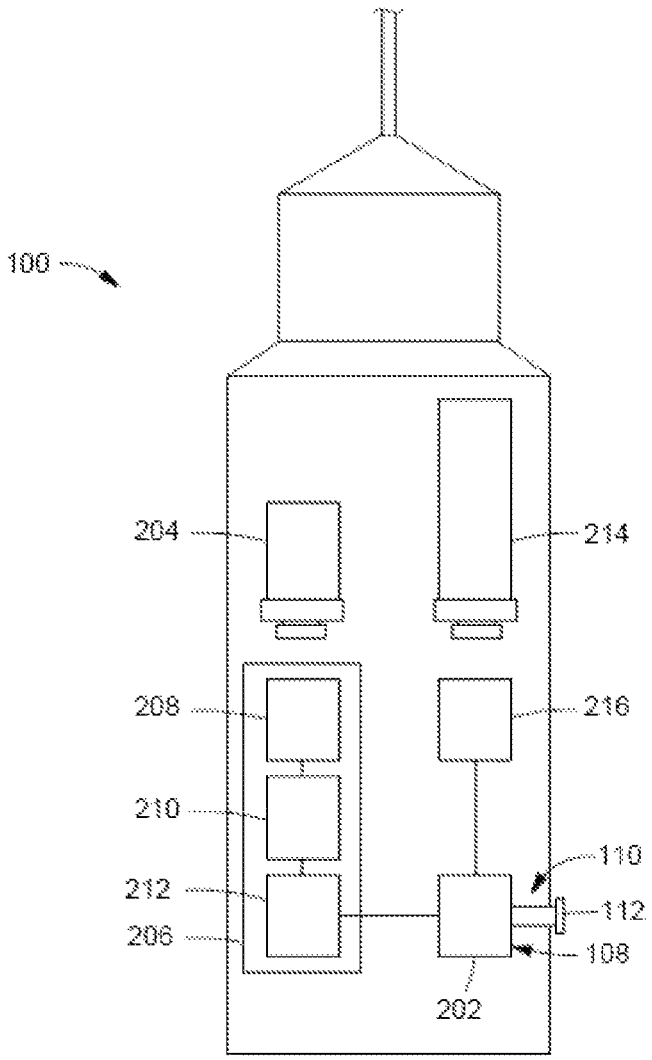
FIG. 2 is an enlarged schematic illustration of the core sampling assembly of FIG. 1, according to aspects of the present disclosure.

FIG. 2 is an enlarged schematic illustration of the core sampling assembly 106 of FIG. 1 according to one or more aspects of the present disclosure. As noted above, the core sampling assembly 106 includes the coring assembly 108 with the coring bit 112. A hydraulic coring motor 202 is operatively coupled to rotationally drive the coring bit 112 to cut into the formation F and obtain a core sample.

To drive the coring bit 112 into the formation F, the coring bit 112 is pressed into the formation F while the bit 112 rotates. Thus, the core sampling assembly 106 applies a weight-on-bit (WOB), which is a force that presses the coring bit 112 into the formation F, and a torque to the coring bit 112. FIG. 2 schematically depicts mechanisms for applying both of these forces. For example, the WOB may be generated by a motor 204, which may be an alternating current (AC), brushless direct current (DC), or other power source, and a control assembly 206. The control assembly 206 may include a hydraulic pump 208, a feedback flow control ("FFC") valve 210, and a piston 212 (also referred to herein as the "kinematics piston"). The motor 204 supplies power to the hydraulic pump 208, while the flow of hydraulic fluid from the pump 208 is regulated by the FFC valve 210. The pressure of the hydraulic fluid drives the piston 212 to apply a WOB to the coring bit 112.

Torque may be supplied to the coring bit 112 by a second motor 214, which may be an AC, brushless DC, or other power source, and a gear pump 216. The second motor 214 drives the gear pump 216, which supplies a flow of hydraulic fluid to the hydraulic coring motor 202. The hydraulic coring motor 202, in turn, imparts a torque to the coring bit 112 that causes the coring bit 112 to rotate.

While specific examples of the mechanisms for applying WOB and torque are provided above, any known mechanisms for generating such forces may be used without departing from the scope of the present disclosure.

Figure 3:
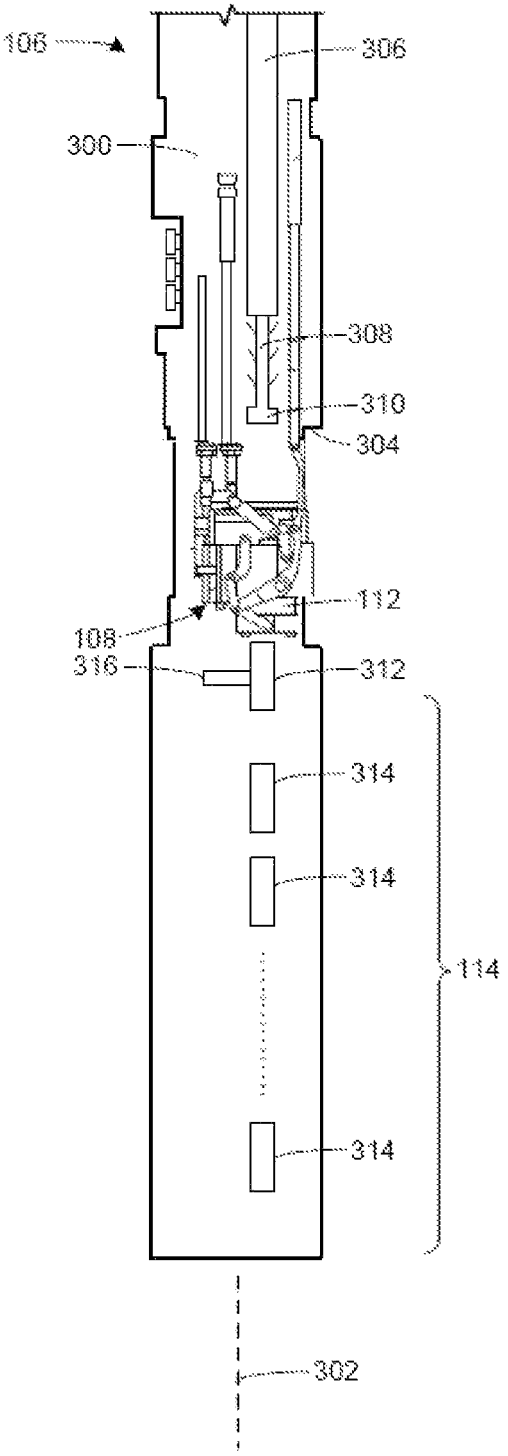
FIG. 3 is a more detailed schematic diagram of the core sampling assembly of FIGS. 1 and 2, according to aspects of the present disclosure.

FIG. 3 is a more detailed schematic diagram of the core sampling assembly 106 of FIGS. 1 and 2 according to one or more aspects of the present disclosure. The core sampling assembly 106 includes a tool body or housing 300 having a longitudinal axis 302. The tool housing 300 defines a coring aperture 304 through which core samples are retrieved via the coring tool assembly 108. The coring tool assembly 108 is coupled to the tool housing 300 to enable the coring tool assembly 108 to rotate and extend the coring bit 112 through the coring aperture 304 of the tool housing 300 and into contact with a formation from which a core sample is to be extracted.

In operation, a handling piston 306 extends a gripper brush 308 having a foot or head 310 through the coring tool assembly 108, a core transfer tube 312 and into the storage area 114. The storage area 114 may contain a plurality of core sample containers 314, some of which may be empty and others of which may have core samples stored therein. Thus, the foot 310 and gripper brush 308 may extend into an opening of an empty core sample container 314 to couple the sample container 314 to the handling piston 306. The handling piston 306 is then retracted to move the empty sample container 314 into the core transfer tube 312. A sample container retainer 316 coupled to the core transfer tube 312 may then be engaged to firmly hold the empty sample container 314 within the core transfer tube 312.

While the empty sample container 314 is held by the sample container retainer 316 within the core transfer tube 312, the handling piston 306 is further retracted out of engagement with the empty sample container 314, through the coring tool assembly 108 and returned to the position depicted in FIG. 3.

The coring tool assembly 108 is then rotated and translated through the coring aperture 304 to engage the coring bit 112 with the location of the formation from which a core sample is to be extracted. Once the coring bit 112 has extracted a core sample, the coring tool assembly 108 rotates back into the position shown in FIG. 3 and the handling piston 306 is again extended so that the foot 310 moves or pushes the core sample out of the coring tool assembly 108 and into the sample container 314 held in the core transfer tube 312. Once the core sample has been deposited in the core sample container 314 held in the core transfer tube 312, a force applied by the sample container retainer 316 to the sample container therein may be reduced to continue to frictionally engage and hold the sample container 314, but allow movement of the sample container 314 relative to the sample container retainer 316 in response to force applied by the handling piston 306. Additionally, this reduced force enables the handling piston 306 to continue to move the sample container 314 toward the storage area 114 without causing damage to the core sample held within the sample container 314 and without causing any substantial damage to the sample container 314.

Figures 4, 5:
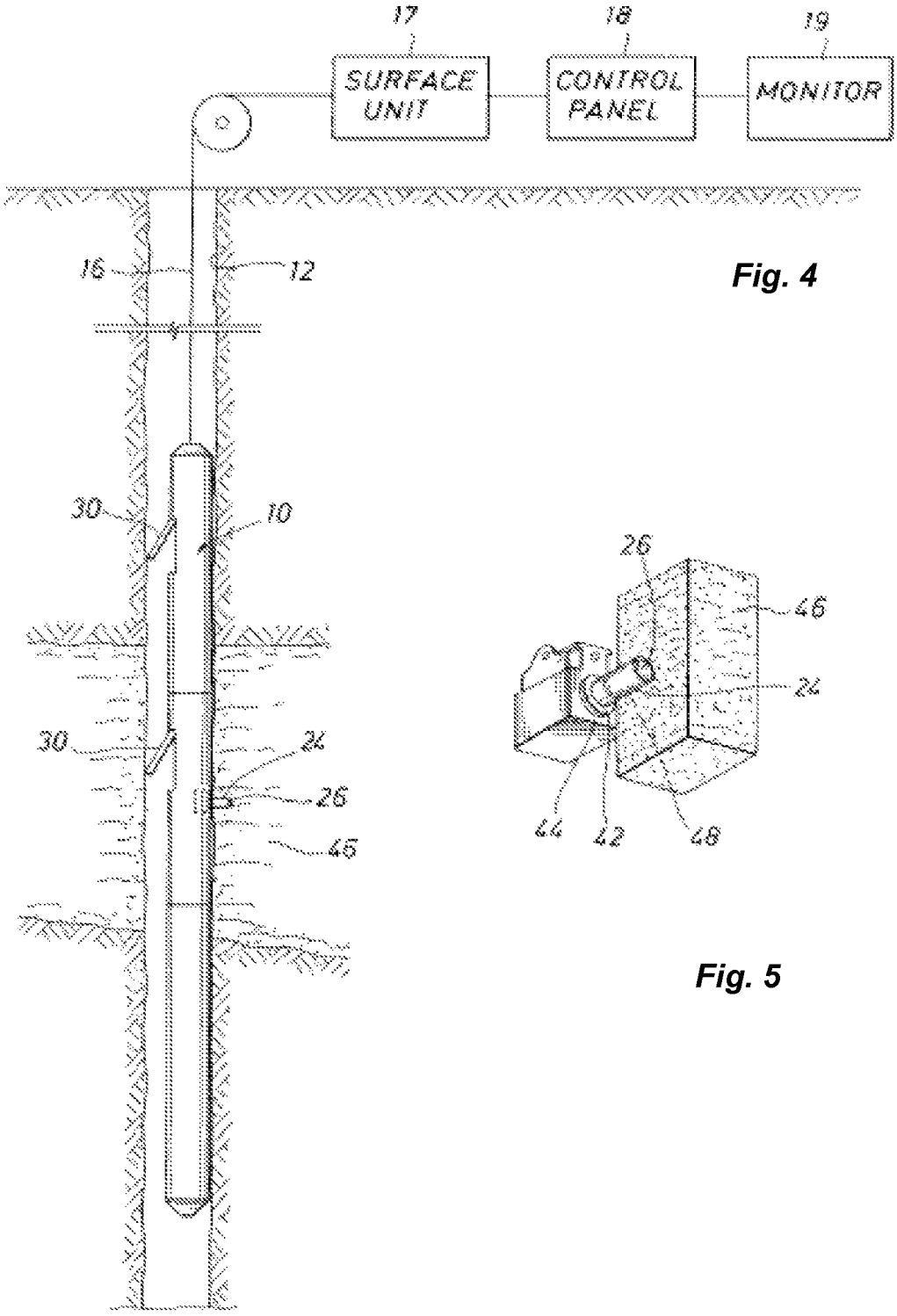
FIG. 4 is a schematic illustration of general features of a coring tool in use in a drilled well for coring a downhole geologic formation, according to aspects of the present disclosure.
FIG. 5 is a perspective view of a coring bit after the coring bit has cut into a target geologic formation, according to aspects of the present disclosure.

FIG. 4 shows the general features of a coring tool in use in a drilled well for coring a downhole geologic formation according to one or more aspects of the present disclosure. One or more aspects of the apparatus shown in FIG. 4 may be substantially similar or identical to those of apparatus shown in FIGS. 1-3.

The coring tool 10 is lowered into the bore hole defined by the bore wall 12, often referred to as the side wall. The coring tool 10 is connected by one or more electrically conducting cables 16 to a surface unit 17 that typically includes a control panel 18 and a monitor 19. The surface unit is designed to provide electric power to the coring tool 10, to monitor the status of downhole coring and activities of other downhole equipment, and to control the activities of the coring tool 10 and other downhole equipment. The coring tool 10 is generally contained within an elongate housing suitable for being lowered into and retrieved from the bore hole. The coring tool 10 contains a coring assembly generally comprising one or more motors 44 powered through the cables 16, a coring bit 24 having a distal, open end 26 for cutting and receiving the core sample, and a mechanical linkage for deploying and retracting the coring bit from and to the coring tool 10 and for rotating the coring bit against the side wall. FIG. 4 shows the core tool 10 in its active, cutting configuration. The coring tool 10 is positioned adjacent to the target geologic formation 46 and secured firmly against the side wall 12 using anchoring arms or shoes 28 and 30 extended from the opposing side of the coring tool from the coring bit. The distal, open end 26 of the coring bit 24 is rotated against the target geologic formation to cut the core sample.

FIG. 5 shows a perspective view of the coring bit 24 after it has cut into the target geologic formation 46. The coring bit 24 is fixedly connected to a base 42 which is, in turn, connected to and turned by a coring motor 44. The core sample 48 is received into the hollow interior of the coring bit 24 as cutting progresses. As described above, the coring bit may be actuated by two independent motors, a coring motor configured to rotate/apply a torque to the coring bit, and a kinematics motor configured to extend/apply a weight (WOB) on the coring bit.

While FIGS. 4 and 5 show the coring tool deployed at the end of a wireline cable, a coring tool within the scope of the present disclosure may be deployed in a well using any known or future-developed conveyance means, including drill pipe, coiled tubing, etc. For example, the coring tool motors may be powered via a downhole mud driven alternator.

Figure 6:
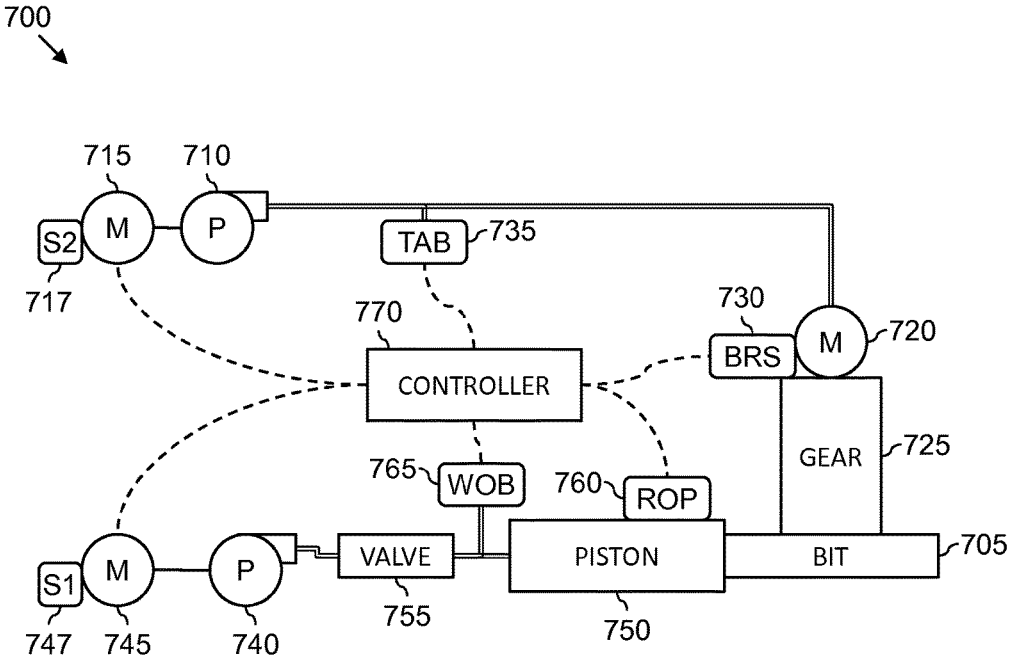
FIG. 6 is a schematic view of an actuation system configured to drive a coring bit, according aspects of the present disclosure.

FIG. 6 is a schematic view of an actuation system 700 configured to drive a coring bit 705 according to one or more aspects of the present disclosure. The actuation system 700 is for use with, and/or a part of, the apparatus shown in FIGS. 1-5.

A hydraulic pump 710, actuated by a bit rotation motor 715 (e.g., a brushless DC motor), provides hydraulic fluid to a hydraulic motor 720. The bit rotation motor 715 may include a resolver configured to measure the rotor position. Thus, the rotating speed S2 of the bit rotation motor 715 may be measured by the resolver and/or another component, schematically depicted in FIG. 6 by S2 sensor 717. The output shaft of hydraulic motor 720 engages a gear 725 which rotationally drives the coring bit 705.

The actuation system 700 also includes a BRS sensor 730. For example, the rotating speed of the shaft of the hydraulic motor 720 may be monitored using a tachometer, such as may include a Hall effect sensor and a magnet coupled to the shaft. The rotating speed of the shaft is equal (or proportional) to the bit rotating speed (BRS). In cases where a direct drive (not shown) between the bit rotation motor 715 and the coring bit 705 is used instead of the hydraulic pump 710 and motor 720, the bit rotating speed may also be determined from the rotating speed S1 of the bit rotation motor 715 (e.g., from data received from speed sensor 717).

The actuation system 700 also includes a TAB sensor 735. For example, the pressure in the hydraulic circuit driving the hydraulic motor 720 may be measured using a pressure gauge to indicate the TAB (proper computations known in the art may be performed to compute the TAB from the pressure). In cases where the hydraulic motor 720 is used (as shown), the ratio of the BRS and the speed S2 of the bit rotation motor 715 may also be used to determine the TAB. In cases where a direct drive (not shown) between the bit rotation motor 715 and the coring bit 705 is used instead of the hydraulic pump 710 and motor 720, the TAB may be determined from a current level driving the bit rotation motor 715 if the motor is a DC motor, or from a phase shift if the motor is an AC motor.

A hydraulic pump 740, actuated by a WOB motor 745 (e.g., a brushless DC motor) provides hydraulic fluid to a kinematics piston 750. The WOB motor 745 may include a resolver configured to measure the rotor position. Thus, the rotating speed S1 of the WOB motor 745 may be measured by the resolver and/or another component, schematically depicted in FIG. 6 by S1 sensor 747. An accumulator (not shown) configured to store hydraulic fluid may be provided between the hydraulic pump 740 and a valve 755, for damping the pressure response of the hydraulic circuit between the pump 740 and the kinematics piston 750.

The actuation system 700 also includes a ROP sensor 760. For example, the extension of the kinematics piston 750 may be monitored using a linear potentiometer to indicate the coring bit ROP (proper computations known in the art may be performed to compute the bit ROP from the voltage reading). In cases where the hydraulic pump 740 is used (as shown), a flow rate sensor disposed in the hydraulic circuit driving the piston 750 may alternatively be used to determine the bit ROP. In cases where a direct drive (not shown) between the WOB motor 745 and the kinematics piston 750 is used instead of the hydraulic pump 740, a motor turn counter (e.g., a resolver) may be used to determine the bit ROP.

The actuation system 700 also includes a WOB sensor 765. For example, the pressure in the hydraulic circuit driving the kinematics piston 750 may be measured using a pressure gauge to indicate the WOB (proper computations known in the art may be performed to compute the WOB from the pressure). In cases where a direct drive (not shown) between the WOB motor 745 and kinematics piston 750 is used instead of the hydraulic pump 740, the WOB may be measured using a current sensor configured to measure the current flowing in the WOB motor 745 if the WOB motor is a DC motor, or from a phase shift if the WOB motor is an AC motor.

These measurements discussed above may be transmitted to a surface operator while a coring operation is taking place and may be used to monitor the operation. In addition, an estimate of a formation compressive strength a may be provided using the formula:

$$\sigma = \frac{ROP \cdot WOB + 120\pi BRS \cdot TAB}{A \cdot ROP}$$

where A is the area of the cutting bit. The formula may also be approximated in some cases as:

$$\sigma = \frac{120\pi BRS \cdot TAB}{A \cdot ROP}$$

Some of these measurements (BRS, TAB, ROP, WOB and combinations) may be communicated with a controller 770 of the downhole tool. The controller 770 may be configured to control the bit rotation motor 715 and/or the WOB motor 745, such as to set the target speed of the bit rotation motor 715 and/or the WOB motor 745 based on these measurements. The controller 770 may also be configured to pilot solenoid valves (not shown) configured to control the direction of the kinematics piston 750. While particular examples of sensor implementation are shown in FIG. 6, other implementations are also possible, such as previously discussed.

Figure 7:
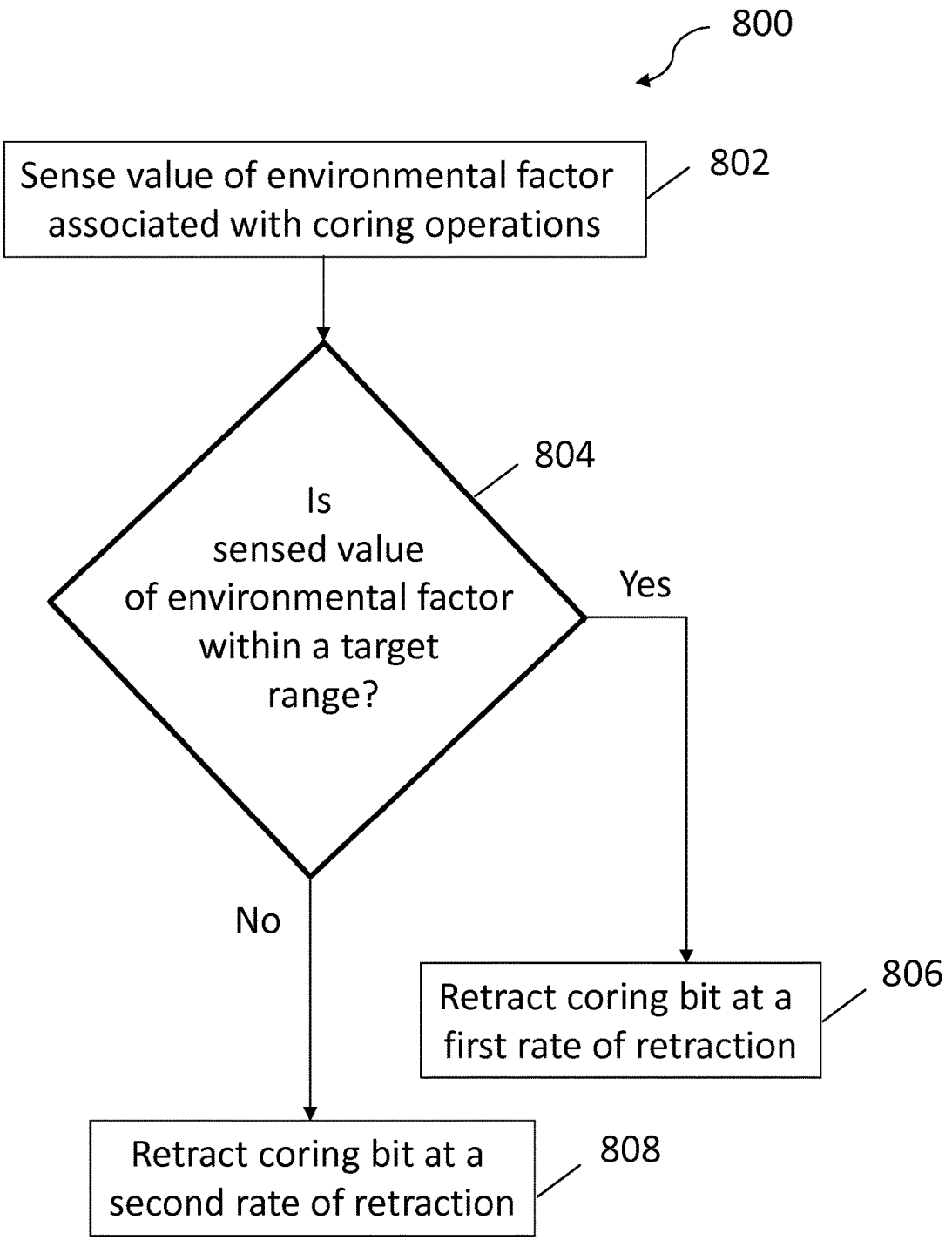
FIG. 7 is a flowchart depicting a method for determining a rate of retraction of a coring bit, according to aspects of the present disclosure.

FIG. 7 is a flowchart depicting an embodiment of a method 800 that may be employed to determine a rate of retraction of the coring bit (e.g., coring bit 24, 112, or 705). The rate of refraction may be expressed in units of length per time. For convenience, the following discussion may also refer to retraction time, which may be expressed in units of time. Retraction time may be used in the disclosed embodiments in addition to, or instead of rate of retraction, such as when the coring bit undergoes a standard or consistent retraction distance. According to certain embodiments, the method 800 may be executed, in whole or in part, by the controller 770 (FIG. 6). For example, the controller 770 may execute code stored within circuitry of the controller 770, or within a separate memory or other tangible readable medium, to perform the method 800. In certain embodiments, the method 800 may be wholly executed while the toolstring 100 or coring tool 10 is disposed within a wellbore. Further, in certain embodiments, the controller 770 may operate in conjunction with a surface controller, such as the control panel 18 (FIG. 5), that may perform one or more operations of the method 800.

The method 800 may begin by sensing (block 802) a value of an environmental factor associated with the coring operations. For example, the sensed value of the environmental factor may be indicative of whether the formation is consolidated or unconsolidated. Examples of such environmental factors include, but are not limited to, a formation hardness, an unconfined compressive strength (UCS) of the formation, a drilling mud weight, a drilling mud viscosity, a formation overbalance, a formation porosity, and other similar factors. Various sensors may be used to provide the sensed value of the environmental factor, such as, but not limited to, a formation hardness sensor, a compressive strength sensor, a formation strength sensor, a drilling mud weight sensor, a drilling mud viscosity sensor, a formation overbalance sensor, a formation porosity sensor, a density sensor, a sonic sensor, a lithology sensor, a logging tool, a gamma sensor, a resistivity sensor, or any combination thereof.

The method may then continue by determining (block 804) whether the sensed value of the environmental factor is within a target range. In certain embodiments, the target range may be associated with the presence of a consolidated formation. For example, a consolidated formation may have an UCS greater than approximately 6,900 kPa. If the sensed value of the environmental factor is within the target range (e.g., an UCS greater than approximately 6,900 kPa), then the method may continue by retracting (block 806) the coring bit at a first rate of retraction. In certain embodiments, the first rate of retraction may correspond to a retraction time of less than approximately 6 seconds. If the sensed value of the environmental factor is not within the target range (e.g., an UCS less than approximately 6,900 kPa), then the method may continue by retracting (block 808) the coring bit at a second rate of retraction. In certain embodiments, the second rate of retraction may correspond to a retraction time greater than approximately 6 seconds. For example, the retraction time when the sensed value of the environmental factor is not within the target range may be greater than approximately 8 seconds, 10 seconds, 15 seconds, or 20 seconds. A sensed value of the environmental factor within the target range may be indicative of a consolidated formation and a sensed value of the environmental factor not within the target range may be indicative of an unconsolidated formation. By using the second rate of retraction (e.g., slower than the first rate of retraction), the possibility of the core being left in the formation, sliding out of the coring bit, or both, may be reduced.

Figure 8:
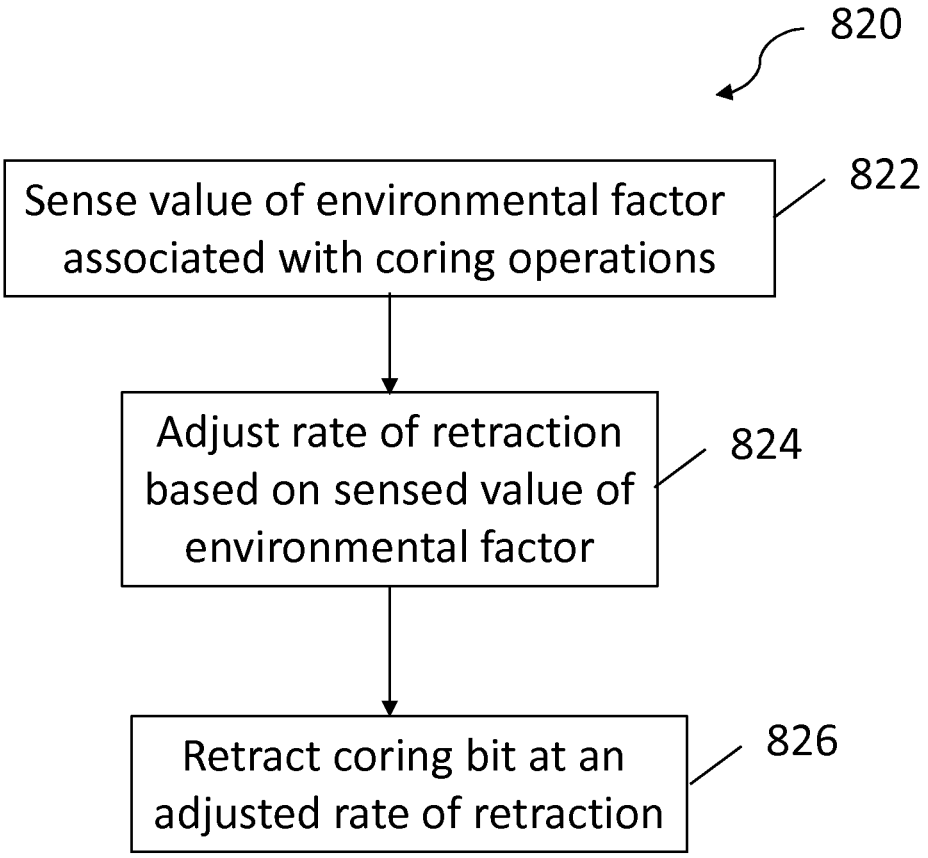
FIG. 8 is a flowchart depicting another method for determining a rate of retraction of a coring bit, according to aspects of the present disclosure.

FIG. 8 is a flowchart depicting an embodiment of a method 820 that may be employed to determine a rate of retraction of the coring bit (e.g., coring bit 24, 112, or 705). According to certain embodiments, the method 820 may be executed, in whole or in part, by the controller 770 (FIG. 6). For example, the controller 770 may execute code stored within circuitry of the controller 770, or within a separate memory or other tangible readable medium, to perform the method 820. In certain embodiments, the method 820 may be wholly executed while the toolstring 100 or coring tool 10 is disposed within a wellbore. Further, in certain embodiments, the controller 770 may operate in conjunction with a surface controller, such as the control panel 18 (FIG. 5), that may perform one or more operations of the method 820.

The method 820 may begin by sensing (block 822) a value of an environmental factor associated with the coring operations. For example, the sensed value of the environmental factor may be indicative of whether the formation is consolidated or unconsolidated. Examples of such environmental factors include, but are not limited to, an unconfined compressive strength (UCS) of the formation, a drilling mud weight, a drilling mud viscosity, a formation overbalance, a formation porosity, and other similar factors.

The method may then continue by adjusting (block 824) the rate of retraction of the coring bit based on the sensed environmental factor. For example, a mathematical relationship may be developed between the rate of retraction (or retraction time) and the sensed environmental factor. The mathematical relationship may be a linear relationship, an exponential relationship, a nonlinear relationship, a quadratic relationship, or any other type of mathematical relationship. The mathematical relationship may be represented by a factor, an equation, a look-up table, a graph, or other representation. Using the mathematical relationship, an adjusted rate of retraction may be obtained. For example, the retraction time may be linearly related to the sensed environmental factor by a factor of approximately 0.004. Thus, the adjusted retraction time may be obtained by multiplying the sensed environmental factor by approximately 0.004. For example, if the sensed environmental factor is a value of UCS of approximately 3,500 kPa, the adjusted retraction time may be obtained by multiplying 3,500 by 0.004 to obtain a retraction time of 14 seconds. After determining the adjusted rate of retraction, the method may continue by retracting (block 826) the coring bit at the adjusted rate of retraction.

In certain embodiments, the disclosed methods may be used at one or more locations along the sidewall of the wellbore. For example, the environmental factors may differ along the sidewall of the wellbore. Accordingly, the disclosed methods may be used to determine the rate of retraction at a first location along the wellbore that is different from the rate of retraction at a second location along the wellbore. Thus, the disclosed methods may be used to help reduce the possibility of the core being left in the formation, sliding out of the coring bit, or both, despite changing environmental factors along the sidewall of the wellbore.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A system, comprising a downhole tool configured for conveyance within a borehole extending into a subterranean formation, wherein the downhole tool comprises:

a hydraulic pump driven by a motor;

an actuator linearly driven by hydraulic fluid received from the hydraulic pump and configured to retract a coring bit of the downhole tool;

a sensor configured to sense a coring operation environmental factor, wherein the coring operation environmental factor is based at least in part on a measurement taken during coring; and a controller configured to execute instructions stored within the downhole tool to determine whether the subterranean formation comprises a consolidated formation or an unconsolidated formation based at least in part on the coring operation environmental factor, and to drive the actuator at an adjustable rate of retraction by regulating a flow of the hydraulic fluid based on whether the subterranean formation is determined to comprise the consolidated formation or the unconsolidated formation.

2. The system of claim 1, wherein the sensor comprises at least one of a formation overbalance sensor, an unconfined compressive strength sensor, a formation strength sensor, a drilling mud weight sensor, a drilling mud viscosity sensor, a formation overbalance sensor, a formation porosity sensor, a density sensor, a sonic sensor, a lithology sensor, a logging tool, a gamma sensor, or a resistivity sensor, or any combination thereof.

3. The system of claim 1, wherein the controller is configured to drive the actuator at a first retraction speed when the sensed coring operation environmental factor indicates coring is occurring in the consolidated formation and at a second retraction speed when the sensed coring operation environmental factor indicates coring is occurring in the unconsolidated formation, wherein the first retraction speed is greater than the second retraction speed.

4. The system of claim 1, wherein the controller is configured to adjust the adjustable rate of retraction based on the sensed coring operation environmental factor.

5. A method, comprising:

positioning a downhole tool in a wellbore extending into a subterranean formation;

commencing coring operations by rotating a coring bit of the downhole tool and extending the rotating coring bit into a location along a sidewall of the wellbore; and adjusting a rate of retraction of the coring bit at the location, without removing the downhole tool from the wellbore, based at least in part on a determination of whether the subterranean formation is consolidated or unconsolidated based at least in part on an environmental factor associated with the coring operations at the location and received during the coring operations while the downhole tool is at the location.

6. The method of claim 5, wherein the first environmental factor comprises at least one of a formation hardness of the subterranean formation, an unconfined compressive strength of the subterranean formation, a drilling mud weight, a drilling mud viscosity, a formation overbalance, or a formation porosity, or any combination thereof.

* * * * *